United States Patent [19]

Bowie

[11] Patent Number: 4,942,973

[45] Date of Patent: Jul. 24, 1990

[54] CONTAINER FOR RELEASING FABRIC CONDITIONERS IN WASHING MACHINES

[76] Inventor: Stuart S. Bowie, 5 Woodbrook La., Swarthmore, Pa. 19081

[21] Appl. No.: 329,302

[22] Filed: Mar. 27, 1989

[51] Int. Cl.[5] ..... B65D 43/04

[52] U.S. Cl. ..... 220/201; 68/17 R; 206/221; 206/524.6; 220/352; 222/54; 252/90; 428/212

[58] Field of Search ..... 206/0.5, 219, 221, 601, 206/603, 524.1, 524.6; 220/200, 201, 352, 354–356; 252/90, 92, 93; 428/321.5, 457, 461, 480, 458, 212, 35.7, 35.8; 222/54; 68/17 R

[56] References Cited

U.S. PATENT DOCUMENTS

| | | | |
|---|---|---|---|
| 2,125,419 | 8/1938 | Birk | 220/201 X |
| 2,529,644 | 11/1950 | Webber | 220/201 |
| 2,585,602 | 12/1952 | Turner | 220/356 |
| 2,698,022 | 12/1954 | Fahnoe | 222/54 X |
| 3,160,319 | 12/1964 | Patzelt et al. | 222/54 |
| 3,198,740 | 8/1965 | Dunlop, Jr. et al. | 252/90 |
| 3,206,059 | 9/1965 | Fead et al. | 220/355 |
| 4,049,151 | 9/1977 | Schweiso | 220/201 |
| 4,188,304 | 2/1980 | Clarke et al. | 206/0.5 X |
| 4,524,078 | 6/1985 | Bardsley et al. | 206/219 X |
| 4,588,080 | 5/1986 | Ginn | 206/219 |
| 4,765,916 | 8/1988 | Ogar, Jr. et al. | 252/90 X |
| 4,795,032 | 1/1989 | Kandathil | 206/0.5 X |

FOREIGN PATENT DOCUMENTS

| | | | |
|---|---|---|---|
| 748265 | 12/1966 | Canada | 220/356 |
| 324935 | 10/1957 | Switzerland | 220/356 |

*Primary Examiner*—Byron P. Gehman

[57] ABSTRACT

A container having at least one detachable component particularly useful for dispensing a liquid or powder fabric conditioner. The component breaks or detaches in response to temperature change. Thus, when the container is placed in a clothes washer, the washing cycle is set to a warm or hot temperature and the final rinsing cycle is set to cold. The cold water causes the component to separate, so that the conditioner is released into the rinse water.

5 Claims, 2 Drawing Sheets

CONTAINER FOR RELEASING FABRIC CONDITIONERS IN WASHING MACHINES

FIELD OF THE INVENTION

This invention relates to systems for releasing fabric conditioners onto clothes in a clothes washer.

CROSS-REFERENCE TO RELATED APPLICATIONS

There are no related applications.

BACKGROUND

The purpose of this invention is to provide means for delivering fabric conditioners to clothes, fabrics and other textile materials (for ease of reference, such items are referred to herein as "clothes") which are washed in washing machines. (Herein, unless stated otherwise, "conditioner" and "conditioners" include fabric softeners, anti-static agents, deodorants, perfumes and other fabric conditioners Fabric softeners are the primary concern of this invention.)

Virtually everyone is aware of the pleasing feel and effect a truly soft towel, shirt, pair of socks, undergarment, etc. has when brought into contact with their body. However, when such items are washed with current detergents, the softness quickly disappears and the items become coarse. (Herein, "detergents" include soaps as well as detergents.) This is probably a result of mineral deposits, precipitation of certain components in the detergents and other factors.

Attempts to avoid such coarseness have been made by adding fabric softeners to detergents, such as by mixing dry or liquid detergents and softeners. This approach has also proven to be unsuccessful and can even increase the coarseness. One explanation for the latter result can be found in U.S. Pat. No. 4,659,496 (Amway Corporation):

"Most fabric softeners /antistatic compounds provide softening and antistatic action by depositing cationic particles onto fabric surfaces. They impart desirable qualities such as pleasing, tactile properties, reduction of static electricity and the adherence of dirt and dust particles, reduction of fabric wrinkles and generally permit treated fabrics to be more easily separated following the drying cycle. Typically, fabric softeners/antistatic contain a cationic quaternary ammonia compound These positively charged particles, however, interfere with anionic soil components as well as with anionic surfactants which are present in many conventional detergent compounds. This charge attraction between cationic and anionic components forms unwanted precipitates which may accumulate on fabric surfaces commonly in the form of redeposited soil. In order to eliminate this source of interference, it is desirable to keep anionic and cationic components separated during the laundering process." (Emphasis supplied.)

The art has long sought a satisfactory solution to the above problem. While the art has developed a large number of softener and other conditioning agents (described below), none have worked properly when mixed or otherwise packaged with detergents. The only known method of achieving acceptable conditioning is, as mentioned above, that of introducing the conditioner separately into the washing machine by hand after the detergent has been rinsed out—and this method is, quite obviously, impracticable for most persons.

To explain, some years ago, certain automatic washing machines had devices designed to release conditioners at the "right" time, i.e., after the detergent had been rinsed away by the first rinse cycle. Such machines then released the conditioners during the second rinse cycle In this manner, the conditioners did not react with the detergent and, moreover, the conditioners were thereby allowed to permeate the clothing. Consequently, the clothing, when dried, were very soft and, when antistatic agents were included (as is usually the case)—free of static cling.

For whatever reason, few if any automatic washers currently sold have such conditioner delivery devices. Accordingly, manufacturers of detergents have been forced to use other modes of introducing conditioners into washing machines. (There are several companies in the United States which continue to sell liquid conditioners. However, such conditioners can only be properly used if the person washing his or her clothes has a timer or sits and watches the automatic washer until it begins its second rinse cycle to pour the conditioners in. Alternatively, the person can wait until the washer completes all cycles and shuts down, at which time the person can pour the conditioner onto the clothes, move the control to the second rinse and re-start the machine—all at a waste of time and convenience. Since this is impractical for almost everyone, especially with so many women working, the bottled liquid (or dried) conditioners now on the U. S. market which, by their own labels require their conditioners be introduced only after the first rinse, do not solve the delivery problem.

A number of companies have simply mixed conditioners with detergent. See, for example, U.S. Pat. No. 3,936,537. None of these mixtures provides adequate conditioning. Indeed, the clothes so treated are harsh to the touch, undoubtedly because the conditioners react with the detergents to form precipitates.

Companies have also attempted to solve the problem b impregnating conditioners on or within pouches or on conditioner sheets for use in the washer and/or the dryer. See U.S. Pat. Nos. 4,733,744 and 4,659,496; 4,229,475; 4,229,475; 4,308,306; 3,686,025; 4,255,484; 3,936,538; 3,632,396; 4,356,099; 4,389,448; 4,659,496; and 3,896,033. These do not condition clothes adequately. Those configurations which mix detergents and conditioners suffer from the drawbacks noted above. In addition, the highly promoted "dryer sheets'-'—which are impregnated with conditioners—are very inadequate. Undoubtedly, this is due in part to the fact that a small sheet in a large mass of clothes in a tumble dryer simply cannot release enough conditioners—especially softeners—to improve feel.

Another approach is exemplified by U.S. Pat. Nos. 4,082,678 and 3,947,971. The '678 Patent discloses a so-called "inner receptacle" containing the conditioners which "serves to prevent the fabric conditioning composition from being released to the fabrics until the rinse cycle of the washer and the drying cycle of the dryer. The receptacle thus must have at least a part of one wall which is water soluble/dispersible but is insolubilized during the wash cycle by the maintenance of a sufficient electrolyte level and/or the appropriate pH." (Col 6, lines 33–40) It is not believed that the system of the '668 Patent ever reached commercial success.

The '971 Patent discloses a softener in a tablet which is encased in sheets. Again, it is believed that this system was never successful. See also U.S. Pat. No. 4,348,293.

Thus, prior systems do not adequately perform as means to deliver conditioners.

SUMMARY

As will be seen, there are a large number of effective conditioners which have been developed by the art. However, particularly with respect to softeners, the technical problem is—and has been—to deliver the softeners into the rinse water of the washing machine after the detergent has been substantially flushed out of the water in order to avoid the reaction between components of the conditioners and components of the detergent.

Stated in a non-limiting way, the solution to the technical problem is set forth by the present invention. Thus, generally, instead of mixing conditioners and detergents in pouches, etc., or impregnating them onto sheets for the washer, or impregnating conditioners onto dryer sheets, the present invention presents a radical departure from such unworkable delivery systems.

Accordingly, broadly described in a non-limiting fashion, this invention provides a new methods for conditioning clothes and novel containers for conditioners. In all embodiments, the containers of this invention open in a washing machine when the hot or warm wash water is replaced with cold rinse water.

The basic concept of the methods and containers of this invention is the provision of a container which is either initially constructed with at least one detachable part or component (there could be more) or which may, alternatively, be an integral container which is capable of being broken. The containers are sold full of conditioners, the person washing clothes places the container into the washing machine at the onset of the wash cycle with the detergent and sets the wash cycle to hot or warm, and the rinse temperature to cold. The present containers remain intact during the hot or warm wash cycle, but the detachable part or component separates and releases the conditioner during the cold rinse cycle, thereby completely impregnating the clothes and providing very superior softening and other fabric conditioning effects during the final rinse.

Following that basic concept, there is provided a container which, in one embodiment, has a frangible area which is surrounded by thermoresponsive material, whereby the thermoresponsive material contracts when it is cooled by the cold rinse water and so that its consequent contraction ruptures the frangible material. This, of course, ruptures the container which releases the conditioner into the rinse water at exactly the "right" time, i.e., after the detergent has been removed by the rinse water so that adverse precipitation reactions are prevented and so that the conditioners can adequately permeate the clothing and thus provide optimum softening and other conditioning effects. This is accomplished by placing the container into the washing machine at the beginning of the wash, so that the individual doing the wash does not need to be present.

Another set of embodiments may be generally described as two-part containers, preferably of rigid plastic, wherein one part is made of material which contracts with temperature to a greater degree than the other part. Thus, when the former encounters the cold rinse water, it contracts and separates from the other part. This action, along with the tumbling action of the washing machine, causes the two parts to disassociate so that the conditioners are released into the rinse water.

Other embodiments of the invention will be described below and are illustrated in the drawings.

DETAILED DESCRIPTION

Figure 1:
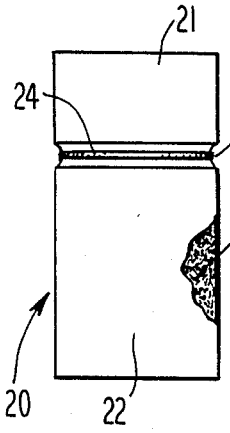
FIG. 1 is a schematic view in elevation of a first embodiment of the container of this invention.

As described above, the fatal flaw with present attempts to condition clothing is that the packages either mix detergents and conditioners—which react to coarsen the materials—or by impregnating dryer sheets with conditioners—which just do not work effectively.

Since few persons can sit by their washing machine until the detergent is rinsed out and then add conditioners to the final rinse, the art has completely failed to solve this important technical problem.

The problem is solved by the present invention, as will now be described in detail.

As indicated, the present invention provides containers which break or fracture in response to temperature change, including those which have "break-away" or detachable portion(s). The fracturing or detachment occurs when the container encounters the cold rinse water after warm or hot washing water, i.e., at the "right" time because the detergent is in the process of being rinsed out or has been completely rinsed out.

For purposes hereof, including the claims, the term "warm" used to describe the temperature of water in a washing machine during the wash cycle means temperatures in the range of about 110–140 degrees F and the term "hot" means temperatures in the range of about 110–140 degrees F, although these ranges can vary considerably depending upon a particular machine and, of course, the setting of the temperature of the water heater serving the machine. For the same purposes, the terms "cold" and "rinse water" used to describe the temperature of the rinse water in a typical washing machine is in the range of about 40–60 degrees F, although these temperatures can vary depending upon external factors.

In order to achieve this result—and to understand how it occurs—reference must be made initially to the law of thermal expansion. Stated simply, "linear expansivity is the fractional increase in length of a specimen of a solid, per unit rise in temperature." (Concise Science Dictionary, Oxford University Press, 1984.)

For some metals, the linear coefficients of expansion are as follows (reproduced from "ASM Metals Reference Book", published by the American Society For metals, 1983):

Linear thermal expansion of metals and alloys

| Metal or alloy | Temperature, °C. | Coefficient of expansion μin./in °C. |
|---|---|---|
| Aluminum and aluminum alloys | | |
| Aluminum (99.9969) | 20–100 | 23.6 |
| Wrought alloys | | |
| EC 1060 1100 | 20–100 | 23.6 |
| 2011.2011 | 20–100 | 23.0 |
| 2024 | 20–100 | 22.8 |
| 2218 | 20–100 | 22.3 |
| 3003 | 20–100 | 23.2 |
| 4032 | 20–100 | 19.4 |
| 5005, 5050, 5052 | 20–100 | 23.8 |
| 5056 | 20–100 | 24.1 |
| 5083 | 20–100 | 23.4 |
| 5086 | 60–300 | 23.9 |
| 5154 | 20–100 | 23.9 |
| 5357 | 20–100 | 23.7 |
| 5456 | 20–100 | 23.9 |
| 6061, 6063 | 20–100 | 23.4 |
| Jewelry bronze, 87.5' | 20–300 | 18.6 |
| Red brass, 85% | 20–300 | 18.7 |
| Low brass, 80% | 20–300 | 19.1 |
| Cartridge brass 70% | 20–300 | 19.9 |
| Yellow brass | 20–300 | 20.3 |
| Muntz metal | 20–300 | 20.8 |
| Leaded commercial bronze | 20–300 | 18.4 |
| Low-leaded brass | 20–300 | 20.2 |
| Medium-headed brass | 20–300 | 20.3 |
| High-headed brass | 20–300 | 20.3 |
| Extra-high leaded brass | 20–300 | 20.5 |
| Free-cutting brass | 20–300 | 20.5 |
| Leaded Muntz metal | 20–300 | 20.8 |
| Forging brass | 20–300 | 20.7 |
| Architectural bronze | 20–300 | 20.9 |
| Inhibited admirally | 20–300 | 20.2 |
| Naval brass | 20–300 | 21.2 |
| Leaded naval brass | 20–300 | 21.2 |
| Manganese bronze (A) | 20–300 | 21.2 |
| Phosphor bronze, 5% (A) | 20–300 | 17.8 |
| Phosphor bronze, 8% (C) | 20–300 | 18.2 |
| Phosphor bronze, 10% (D) | 20–300 | 18.4 |
| Phosphor bronze, 1.25% | 20–300 | 17.8 |
| Free-cutting phosphat bronze | 20–300 | 17.3 |
| Cupro nickel 30% | 20–300 | 16.2 |
| Cupro nickel 10% | 20–300 | 17.1 |
| Nickel silver, 65.18 | 20–300 | 16.2 |
| Nickel silver, 55.18 | 20–300 | 16.7 |
| Nickel silver, 65.12 | 20–300 | 16.2 |
| High-silicon bronze (A) | 20–300 | 18.0 |
| Low silicon bronze (B) | 20–300 | 17.9 |
| Aluminum bronze (3) | 20–300 | 16.4 |
| Aluminum silicon bronze | 20–300 | 18.0 |
| Aluminum bronze (1) | 20–300 | 16.8 |
| Beryllium copper | 20–300 | 17.8 |

-continued

Linear thermal expansion of metals and alloys

| Metal or alloy | Temperature, °C. | Coefficient of expansion μin./in °C. |
|---|---|---|
| Casting alloys | | |
| 88 Cu . 88 Sn . 4 Zn | 21–177 | 18.0 |
| 88 Cu . 11 Sn | 20–300 | 18.4 |
| 88 Cu . 6 Sn 15 Ph 45 Zn | 21–260 | 18.5 |
| 87 Cu . 8 Sn 1 Pb . 4 Zn | 21–177 | 18.0 |
| 88 Cu . 10 Sn 10 Pb | 21–204 | 18.5 |
| 78 Cu . 7 Sn 15 Pb | 21–204 | 18.5 |
| 85 Cu . 8 Sn 51 Pb 5 Zn | 21–204 | 18.1 |
| 72 Cu . 1 Sn 3 Pb 24 Zn | 21–93 | 20.7 |
| 67 Cu . 1 Sn 3 Pb 24 Zn | 21–93 | 20.2 |
| 61 Cu . 1 Sn 11 Pb 37 Zn | 21–260 | 21.6 |
| Manganese bronze | | |
| 60 kg | 21–204 | 20.5 |
| 65 kg | 21–93 | 21.6 |
| 110 kg | 21–260 | 19.8 |
| 6101, 6151 | 20–100 | 23.0 |
| 7075 | 20–100 | 23.2 |
| 7079, 7178 | 20–100 | 23.4 |
| Casting alloys | | |
| Al3 | 20–100 | 20.4 |
| 43 and 108 | 20–100 | 22.0 |
| A108 | 20–100 | 21.5 |
| A132 | 20–100 | 19.0 |
| D132 | 20–100 | 20.5 |
| F132 | 20–100 | 20.7 |
| 138 | 20–100 | 21.4 |
| 142 | 20–100 | 22.5 |
| 195 | 20–100 | 23.0 |
| B195 | 20–100 | 22.0 |
| 214 | 20–100 | 21.0 |
| 220 | 20–100 | 25.0 |
| 319 | 20–100 | 21.5 |
| 355 | 20–100 | 22.0 |
| 356 | 20–100 | 21.5 |
| 360 | 20–100 | 21.0 |
| Aluminum bronze | | |
| Alloy 9A | | 17 |
| Alloy 9B | 20–250 | 17 |
| Alloy 9C, 9D | | 16.2 |
| Iron and iron alloys | | |
| Pure iron | 20 | 11.7 |
| Fe C alloys | | |
| 0.06% C | 20–100 | 11.7 |
| 0.22% C | 20–100 | 11.7 |
| 0.40% C | 20–100 | 11.3 |
| 0.56% C | 20–100 | 11.0 |
| 1.08% C | 20–100 | 10.8 |
| 1.45% C | 20–100 | 10.1 |
| Invar (36% Ni) | 20 | 0–2 |
| 13 Mn 1.2 C | 20 | 18.0 |
| 13 Cr 0.35 C | 20–100 | 10.0 |
| 12.3 Cr 0.4 Ni 0.09 C | 20–100 | 9.8 |
| 17.7 Cr 9.6 Ni 0.06 C | 20–100 | 16.5 |
| 18 W 4 Cr 1 V | 0–100 | 11.2 |
| Gray cast iron | 0–100 | 10.5 |
| Malleable iron (pearlite) | 20–400 | 12 |
| Lead and lead alloys | | |
| Corroding lead (99.73 +% Pb) | 17–100 | 29.3 |
| 5.95 solder | 15–110 | 28.7 |
| 20.80 solder | 15–110 | 26.5 |
| 50.50 solder | 15–110 | 23.4 |
| 1', antimonial lead | 20–100 | 28.8 |
| Hard lead (96 Pb-4 Sh) | 20–100 | 27.8 |
| Hard lead (94 Pb 68b | 20–100 | 27.2 |
| 8% antimonial lead | 20–100 | 26.7 |
| 9% antimonial lead | 20–100 | 26.4 |
| Lead base babbitt | | |
| SAE 14 | 20–100 | 19.6 |
| Alloy 8 | 20–100 | 24.0 |

-continued

Linear thermal expansion of metals and alloys

| Metal or alloy | Temperature, °C. | Coefficient of expansion μin./in °C. |
|---|---|---|
| **Magnesium and magnesium alloys** | | |
| Magnesium (99.8%) | 20 | 25.2 |
| Casting alloys | | |
| AM100A | 18–100 | 25.2 |
| AZ63A | 20–100 | 26.1 |
| AZ91A.B.C | 20–100 | 26 |
| AZ92A | 18–100 | 25.2 |
| HZ32A | 20–200 | 26.7 |
| ZH42 | 20–200 | 27 |
| ZH62A | 20–200 | 27.1 |
| ZK51A | 20 | 26.1 |
| EZ33A | 20–100 | 26.1 |
| EK30A, EK41A | 20–100 | 26.1 |
| Wrought alloys | | |
| M1A, A3A | 20–100 | 26 |
| AZ31B, PE | 20–100 | 26 |
| AZ61A, AZ80A | 20–100 | 26 |
| ZK60A, B | 20–100 | 26 |
| HM31A | 20–93 | 26.1 |
| 750 | 20–100 | 23.1 |
| 40E | 21–93 | 24.7 |
| **Copper and copper alloys** | | |
| Wrought coppers | | |
| Pure copper | 20 | 16.5 |
| Electrolytic tough pitch copper (ETP | 20–100 | 16.8 |
| Deoxidized copper high residual phosphorous (DHP | 20–300 | 17.7 |
| Oxygen free copper | 20–300 | 17.7 |
| Free machining copper 0.5% Te or 1% Pb | 20–300 | 17.7 |
| Wrought alloys | | |
| Gilding, 95% | 20–300 | 18.1 |
| Commercial bronze, 90% | 20–300 | 18.4 |
| **Nickel and nickel alloys** | | |
| Nickel (99.95% Ni + Co) | 0–100 | 13.3 |
| Duranickel | 0–100 | 13.0 |
| Monel | 0–100 | 14.0 |
| Monel (cast) | 25–100 | 12.9 |
| Inconel | 20–100 | 11.5 |
| Nionel | 27–93 | 12.9 |
| Hastelloy B | 0–100 | 10.0 |
| Hastelloy C | 0–100 | 11.3 |
| Hastelloy D | 0–100 | 11.0 |
| Hastelloy F | 20–100 | 14.2 |
| Hastelloy N | 21–204 | 10.4 |
| Hastelloy W | 23–100 | 11.3 |
| Hastelloy X | 26–100 | 13.8 |
| Illium G | 0–100 | 12.19 |
| Illium P | 0–100 | 12.02 |
| 80 Ni-20 Cr | 20–1000 | 17.3 |
| 60 Ni-24 Fe-16 Cr | 20–1000 | 17.0 |
| 35 Ni-45 Fe-20 Cr | 20–500 | 15.8 |
| Constantan | 20–1000 | 18.8 |
| **Tin and tin alloys** | | |

-continued

Linear thermal expansion of metals and alloys

| Metal or alloy | Temperature, °C. | Coefficient of expansion μin./in °C. |
|---|---|---|
| Pure tin | 0–100 | 23 |
| Solder (70 Sn—30 Pb) | 15–110 | 21.6 |
| Solder (63 Sn —37 Pb) | 15–110 | 24.7 |
| **Titanium and titanium alloys** | | |
| 99.9% Ti | 20 | 8.41 |
| 99.0% Ti | 93 | 8.55 |
| Ti-5 Al 2.5 Sn | 93 | 9.36 |
| Ti-8 Mn | 93 | 8.64 |
| **Zinc and zinc alloys** | | |
| Pure zinc | 20–250 | 39.7 |
| AG40A alloy | 20–100 | 27.4 |
| AC41A alloy | 20–40 | 27.4 |
| Commercial rolled zinc | | |
| 0.08 Pb | 20–40 | 32.5 |
| 0.3 Pb, 0.3 Cd | 20–98 | 33.9 (a) |
| Rolled zinc alloy (1 Cu, 0.010 Mg) | 20–100 | 34.8 (b) |
| Zn—Cu—Ti alloy (0.8 Cu, 0.15 Ti) | 20–100 | 24.9 (c) |
| **Pure metals** | | |
| Beryllium | 25–100 | 11.6 |
| Cadmium | 20 | 29.8 |
| Calcium | 0–400 | 22.3 |
| Chromium | 20 | 6.2 |
| Cobalt | 20 | 13.8 |
| Gold | 20 | 14.2 |
| Iridium | 20 | 6.8 |
| Lithium | 20 | 56 |
| Manganese | 0–100 | 22 |
| Palladium | 20 | 11.76 |
| Platinum | 20 | 8.9 |
| Rhenium | 20–500 | 6.7 |
| Rhodium | 20–100 | 8.3 |
| Ruthenium | 20 | 9.1 |
| Silicon | 0–1400 | 5 |
| Silver | 0–100 | 19.68 |
| Tungsten | 27 | 4.6 |
| Vanadium | 23–100 | 8.3 |
| Zirconium | | 5.85 |

Certain of the metals, such as Aluminum, could be used as containers or container components for this invention. However, as will be explained, they are deemed most useful as wires or bands which surround a frangible container section (of frangible plastic or the like) which has a lower coefficient of linear expansion than the metal, so that, when the unit is subjected to cold water, the wire or band contracts by a sufficient amount to cause the relatively non-contractive section to fracture and release the conditioner.

Thus, generally speaking, plastics are the preferred materials for containers of this invention and, where used, metals for surrounding bands or wires.

Indeed, containers of this invention wherein a wire surrounds a frangible section—work best when the plastic of the container is hard and brittle under all temperatures of the washing cycles, so that the contraction of the wire can more easily fracture the frangible section.

Reproduced below from "Structural Plastics Design Manual" published by the American Society of Civil Engineers is Table 1-1 which sets forth properties of certain thermoplastic and thermosetting materials:

TABLE 1-1

Structural and Physical Properties and Processing Methods for Representative Engineering Plastics (1.2)*

| PROPERTY Material Type | ASTM Test | Acrylics PMMA Cast Sheet | Polyacetal Homopolymer | Polyvinyl Ch PVC Rigid | Acrylonitrile-Butodiene-Styrene ABS High Impact | Polyethylene PE High Density HDPE | Polypropylene PP Unmodified | Polycarbonate PC Unfilled | Nylon PA Type 616 Unmodified |
|---|---|---|---|---|---|---|---|---|---|
| | | THERMOPLASTICS | | | | | | | |
| 1. Specific Gravity | D792 | 1.17–1.20 | 1.42 | 1.30–1.5 | 1.01–1.04 | 0.94–0.97 | 0.90–0.91 | 1.20 | 1.13–1.15 |
| 2. Tensile Strength, psi | D638 | 8000–11000 | 10000 | 6000–75 | 4800–6300 | 3100–5500 | 4300–5500 | 8000–9500 | 12000 |
| 3. Elongation, % | D638 | 2–7 | 25–75 | 40–80 | 5–70 | 20–1300 | 200–700 | 100–130 | 60 |
| 4. Tensile Elastic Modulus, $10^6$ psi | D638 | 0.35–0.45 | 0.52 | 0.35–0. | 0.23–0.33 | 0.06–0.18 | 0.16–0.23 | 0.30–0.35 | — |
| 5. Compressive Strength, psi | D695 | 11000–19000 | 18000(10% defl.) | 8000–13 | 4500–8000 | 2700–3600 | 5500–8000 | 12500 | 15000 (yield) |
| 6. Flexural Strength, psi | D790 | 12000–17000 | 14100 | 10000–16 | 8000–11000 | — | 6000–8000 | 13500 | 17000 |
| 7. Impact Strength, ft-lb/in, Izod | D256 | 0.3–0.4 | 1.4 (Inj.) 2.3 (Ext.) | 0.4–20 | 6.5–7.5 | 0.5–20.0 | 0.5–2.2 | 12.0–18.0 | 1.0 |
| 8. Hardness, Rockwell | D785 | M80–M100 | M94, R210 | D65–C (Shor | R85–R105 | D60–D70 (Shore) | R80–R110 | M70–M78 R115–R125 | R120 M83 |
| 9. Compressive Elastic Modulus, $10^6$psi | D695 | 0.39–0.48 | 0.67 | — | 0.14–0.30 | — | 0.15–0.30 | 0.35 | — |
| 10. Flexural Elastic Modulus, $10^6$ psi | D790 | 0.39–0.48 | 0.41 | 0.30–0 | 0.25–0.35 | 0.10–0.26 | 0.17–0.25 | 0.32–0.35 | 0.42 |
| 11. Thermal Conductivity, Btu-in/hr-ft$^2$-°F. | C177 | 1.16–1.74 | 1.60 | 1.02–1 | — | 3.19–3.60 | 0.81 | 1.33 | 1.68 |
| 12. Specific Heat, Btu/lbm - °F. | — | 0.35 | 0.35 | 0.25–0 | — | 0.55 | 0.46 | 0.28–0.30 | 0.40 |
| 13. Thermal Expansion, $10^{-6}$ in/in - °F. | D696 | 27.8–50.0 | 55.6 | 27.8–5 | 52.8–61.1 | 61.1–72.2 | 32.2–56.7 | 36.7 | 44.4 |
| 14. Deflection Temperature, °F. | | | | | | | | | |
| 264 psi | D648 | 160–215 | 255 | 140– | 205–215 | 110–130 | 125–140 | 265–285 | 167 |
| 64 psi | | 165–235 | 338 | 135– | 210–225 | 140–190 | 200–250 | 270–290 | 374 |
| 15. Refractive Index | D542 | 1.48–1.50 | 1.48 | 1.52– | — | 1.54 | 1.49 | 1.59 | 1.53 |
| 16. Clarity | — | Transparent to Opaque | Translucent to Opaque | Transl to Op | Translucent to Opaque | — | Transparent to Opaque | Transparent to Opaque | Translucent to Opaque |
| 17. Water Absorption, 24 hr, ⅛in thick, % | D570 | 0.2–0.4 | 0.25 | 0.04– | 0.20–0.45 | 0.01 | 0.01–0.03 | 0.15–0.18 | 1.5 |
| 18. Effect of Sunlight | — | None | Chalks slightly | Varies formu | None to Sun-light Yellowing | Crazes if Unprotected | Crazes if Unprotected | Slight Discolor-ation and Embrittlement | Embrittlement |
| 19. Methods of Processing | — | Injection mold Extrusion Cast Thermoform using cast or extruded sheet | Injection mold Extrusion Blow mold | Injection Extr Blow Calen for ri flexib | Injection mold Extrusion Thermoforming | Injection mold Extrusion Blow mold Rotational mold | Injection mold Extrusion Blow mold Rotational mold | Injection mold Extrusion Thermoforming Rotational mold | Injection mold Extrusion Blow mold Rotational mold Casting |

| PROPERTY Material Type | ASTM Test | Fluoroplastic PTFE | Styrene Acrylonitrile SAN Unfilled | Phenylene Oxide PPO Non-Reinforced | Polyester Cast Rigid | Epoxy EP Cast | Phenol-Formaldehyde PF Wood Flour and Cotton Flock Filled | Melamine Formaldehyde MF Alpha Cellulose Filled | Silicone Si Glass Fiber Filled Molding Compound |
|---|---|---|---|---|---|---|---|---|---|
| | | THERMOPLASTICS | | | THERMOSETS | | | | |
| 1. Specific Gravity | D792 | 2.14–2.20 | 1.08–1.10 | 1.06–1.10 | 1.10–1.46 | 1.11–1.40 | 1.34–1.45 | 1.47–1.52 | 1.80–1.90 |
| 2. Tensile Strength, psi | D638 | 2000–5000 | 9000–12000 | 7800–11500 | 6000–13000 | 4000–13000 | 5000–9000 | 7000–13000 | 4000–6500 |
| 3. Elongation, % | D638 | 200–400 | 1.5–3.7 | 50–60 | 5 | 3–6 | 0.4–0.8 | 0.6–0.9 | — |
| 4. Tensile Elastic Modu-lus, $10^6$ psi | D638 | 0.2 | 0.40–0.56 | 0.36–0.38 | 0.30–0.64 | 0.35 | 0.80–1.70 | 1.20–1.40 | — |
| 5. Compressive Strength, | D695 | 1700 | 14000–17000 | 16000–16400 | 13000–30000 | 15000–25000 | 22000–36000 | 40000–45000 | 10000–15000 |

TABLE 1-1-continued

Structural and Physical Properties and Processing Methods for Representative Engineering Plastics (1.2)*

| | | | | | | | | | |
|---|---|---|---|---|---|---|---|---|---|
| psi | | | | | | | | | |
| 6. Flexural Strength, psi | D790 | — | 14000–19000 | 12800–13500 | 8500–23000 | 13300–21000 | 7000–14000 | 10000–16000 | 10000–140000 |
| 7. Impact Strength, ft-lb/in, Izod | D256 | 3.0 | 0.35–0.50 | 5.0 | 0.20–0.40 | 0.2–1.0 | 0.24–0.60 | 0.24–0.35 | 0.3–8.0 |
| 8. Hardness, Rockwell | D785 | D50-D55 (Shore) | M80-M90 | R113-R119 | M70-M115 | M80-M110 | M100-M115 | M155-125 | M80-M90 |
| 9. Compressive Elastic Modulus, $10^6$ psi | D695 | — | 0.53 | 0.37 | — | — | — | — | — |
| 10. Flexural Elastic Modulus, $10^6$ psi | D790 | — | to 0.55 | 0.36–0.40 | — | — | 1.00–1.20 | 0.11 | 1.0–2.5 |
| 11. Thermal Conductivity, Btu-in/hr-ft$^2$ -°F. | C177 | 1.74 | 0.84 | 1.50 | 1.16 | 1.16–1.45 | 1.16–2.38 | 2.03–2.90 | 2.03–2.61 |
| 12. Specific Heat, Btu/lbm - °F. | — | 0.25 | 0.32–0.34 | 0.32 | — | 0.25 | 0.32–0.40 | 0.40 | 0.19–0.22 |
| 13. Thermal Exapnsion, $10^{-6}$ in/in -°F. | D696 | 55.6 | 20.0–21.1 | 28.9 | 30.6–55.5 | 25.0–36.1 | 16.7–25.0 | 22.2 | 11.1–27.8 |
| 14. Deflection Temperature, °F. | | | | | | | | | |
| 264 psi | D648 | — | 190–220 | 212–265 | 140–400 | 115–550 | 300–370 | 350–370 | 900 |
| 64 psi | | 250 | — | 190–280 | — | — | — | — | — |
| 15. Refractive Index | D542 | 1.35 | 1.56–1.57 | — | 1.52–1.57 | 1.55–1.61 | — | — | — |
| 16. Clarity | — | Opaque | Transparent | Opaque | Transparent to Opaque | Transparent | — | Translucent | Opaque |
| 17. Water Absorption, 24 hr, ⅛in thick, % | D570 | 0.00 | 0.20–0.30 | 0.07 | 0.15–0.60 | 0.08–0.15 | 0.30–1.20 | 0.10–0.60 | 0.2 |
| 18. Effect of Sunlight | — | None | Slight Yellowing | Colors Fade | Slight Yellowing | None | — | Pastels Yellow | None |
| 19. Methods of Processing | — | See text Injection mold Extrusion Injection-blow mold | Compression mold Extrusion | Injection mold | Compression mold Injection mold See reinforced plastics | Compression mold Injection mold See reinforced plastics | Compression mold Transfer mold Injection mold Saturated sheet laminates | Compression mold Transfer mold Injection mold Saturated sheet laminates | Compression mold |

Note:
1 psi = 6.896 kPa; 1 in = 25.4 mm; 1 ft = 0.305 m; 1 Btu-in/hr-ft$^2$-°F. = 0.144 W/m-°K; 1 ft$^2$ = 0.09 m$^2$; 1 Btu/lbm -°F. = 4184.0 J/kg-°K; 1 ft-lb/in = 34.4 J/mm; °F. = 1.8° C. + 32

FIG. 1 shows a first embodiment of container of this invention. As shown the Container 20 is in the shape of a bottle, although many other shapes can be employed.

Container 20 has an upper portion 21 and a lower portion 22 and a groove 23 extending around the container at the junction of portions 21 and 22. A metal wire or band 24 tightly encircles groove 23.

Metal wire 24 is made of a thermoresponsive material, such as copper, which has a higher coefficient of linear expansion than does the material which forms groove 23, which material may be—and undoubtedly should be for ease of commercial production—the same as parts 21 and 22. The material of groove 23, as well as components 21 and 22 can be of any suitable thermosetting or thermoplastic plastic(s) such as those listed in Table I—I above. Polyethylene (PE) or polypropylene (PP) are very good choices for this purpose.

Thus, when the container 20 is placed in the washing machine at the beginning of the washing process and the wash temperature is set at warm (approximately 110–140 degrees F) or hot (approximately 140–170 degrees F), both wire 24 and material 23 expand. More specifically, wire 24 expands to a greater degree than does material 23.

However, when the cold rinse water enters the washing machine—at a temperature usually in the range of about 40–60 degrees F—material 23 contracts only slightly, whereas wire 24, with its high coefficient of linear expansion, contracts to a significantly greater degree, so much so that the constricting force of wire 24 ruptures container 20 at groove 23. (It is preferred that the material of container 20 be made as thin as possible at the area of groove 23 so that it is more easily fractured.) Groove 23, in any event, may be termed the "frangible section".)

Figure 2:
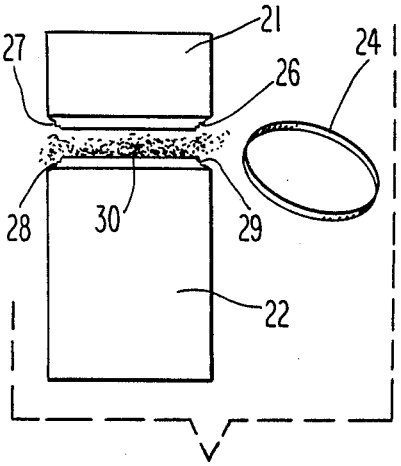
FIG. 2 is also a schematic view, showing the container having its top and bottom portions separated and the thermoresponsive wire detached.

When the rupture occurs, top 21 breaks away from bottom 22, as indicated by ruptures lines 26–29. Wire 24 simply detaches. What happens then is that conditioner 30, which was encased within container 20, is permitted to flow from part 22 as shown in FIG. 2 (and from part 21 if the container is filled above the groove 23). In turn, the conditioner flows into the cold rinse water and completely impregnates the clothes, which by this time are substantially free of detergent. Consequently, there is no adverse reaction between the detergent and conditioner, and the clothes are conditioned is a most desirable way. That is, they are soft and do not have static cling (when antistatic agents are employed.)

Figure 3:
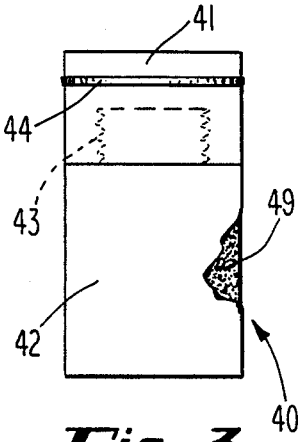
FIG. 3 is a schematic view in elevation of a second embodiment of the container of this invention.
Figure 4:
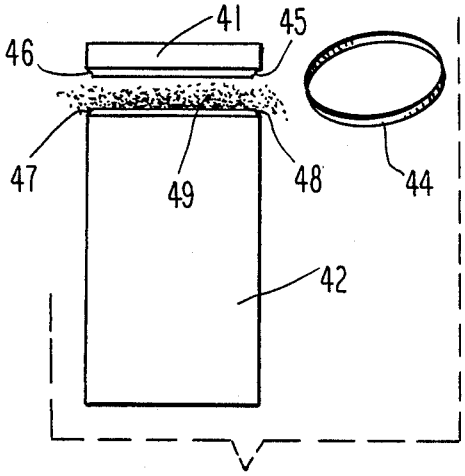
FIG. 4 is also a schematic view, showing the container having its top and bottom portions separated and the thermoresponsive wire detached.

FIGS. 3 and 4 illustrate another embodiment of the invention. In this case, a container 40 has a bottom component 42 and may be cylindrical. Component 42 has external threads 43 around its necked-in upper portion which thread engage matching threads of an upper portion 41. It will be understood the container 42 is filled with conditioner.

A metal band or wire 44 surrounds the upper part of top component 41. As in the case of container 20, the metal has a very high coefficient of linear expansion relative to the coefficient of linear expansion of the material(s)—preferably plastic—of which component 41 is made, so that, as in the case of container 20, when the water is switched from warm to cold in the rinse cycle, wire or band 44 contracts so much that it fractures the part of component 41 which it surrounds.

After such fracturing, as shown in FIG. 4, the upper end of component 41 detaches from its lower end, thereby permitting the escape of the conditioner 49 into the rinse water to condition the clothes. It will be noted that wire or band 44 detaches. Moreover, as shown in FIG. 4, a preferable structure involves the formation of a groove for wire or band 44 as indicated at 45–48.

Figure 5:
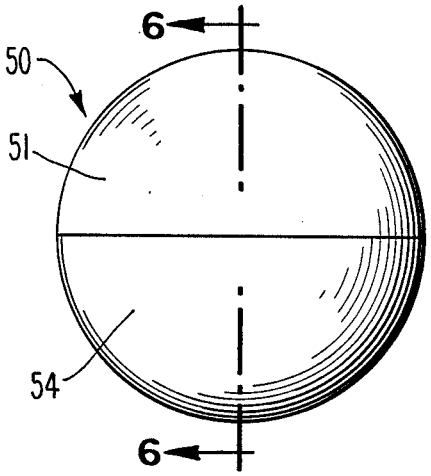
FIG. 5 schmetacally depicts a third embodiment of this invention wherein the container is a sphere.
Figure 6:
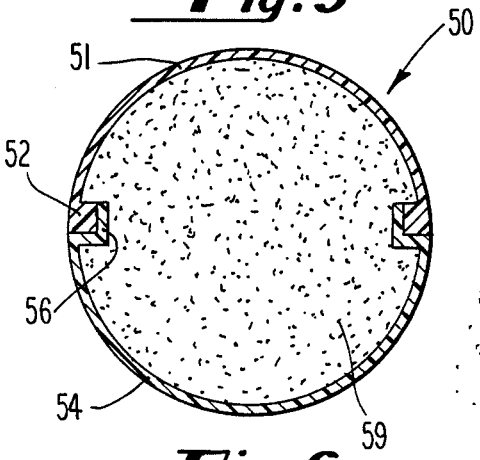
FIG. 6 a a sectional view along the lines 6—6 of FIG. 5.
Figure 7:
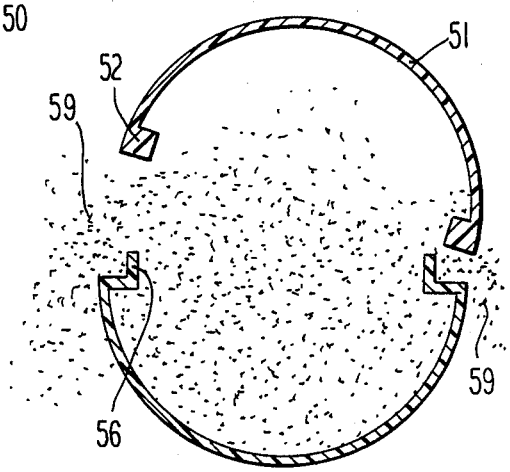
FIG. 7 is a view of the container shown in FIG. 6 after its container parts have become disassociated.

It may be desirable to produce this invention in the form of a sphere and this embodiment is shown in FIGS. 5–7.

Thus, the sphere is generally shown as 50 and preferably is composed of a component, which may be a hemisphere 51, having a relatively low coefficient of linear expansion and a second component, 54 having a relatively high coefficient of linear expansion.

Components 51, 54 are held together by frictional fit under room temperature by means of an inwardly projecting element 52 at the end of component 51 engaging an element 56 formed at the end of component 54.

When the container 50 encounters the cold rinse water, inner component 54 contracts so much that element 56 retracts from engagement from element 52, so that the components parts 51 and 54 detach from each other and the container 59 is free to emerge from the two shells 51, 54 as shown in FIG. 7 and enter the rinse water to impregnate the clothing.

Figure 8:
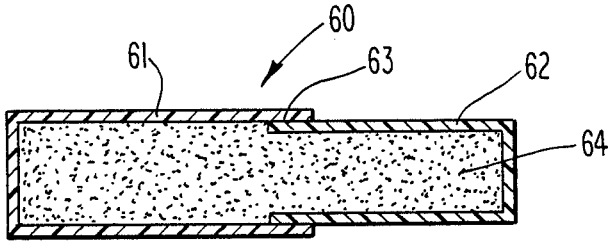
FIG. 8 is a sectional view of a fourth embodiment of the container of this invention wherein the two portions of the container are initially joined by friction fit.
Figure 9:
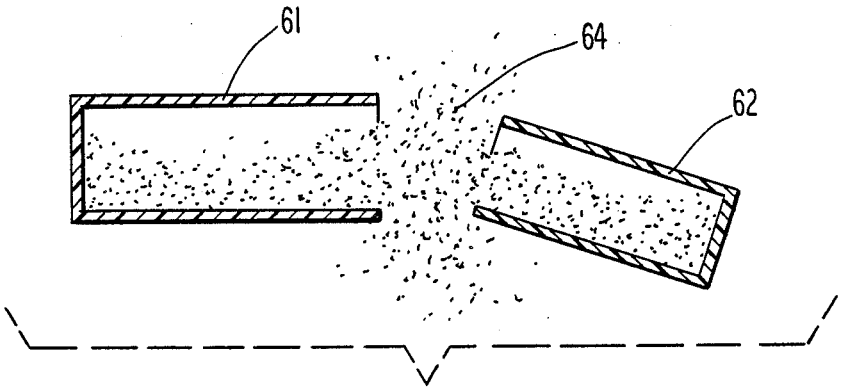
FIG. 9 shows the two component portions after their separation.

FIGS. 8 and 9 show yet another embodiment of this invention wherein there is an inner component 62 which is connected to an outer component 61 by frictional engagement at room temperature at 63 where their respective ends overlap. Again, component 62 has a much higher coefficient of linear expansion than 61 so that, when the cold rinse water is introduced, component 62 contracts more than component 61 and the two components detach, releasing container 64 to the rinse water to condition the clothing. This embodiment may well be highly suitable for commercial manufacture since it may be made of two inexpensive plastics and has no complicated parts.

Figure 10:
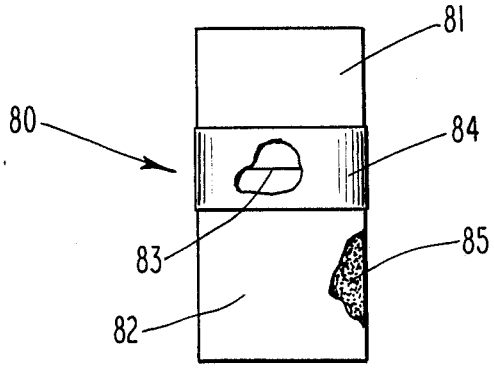
FIG. 10 is a fifth embodiment of the container of this invention wherein the container is in two parts held together by a material which weakens when immersed in cold washing machine rinse water.

FIG. 10 illustrates another form of the invention wherein the container 80 comprises upper and lower portions 81 and 82 whose ends adjoin at 83. The portions 81 and 82 are held together by a plastic band 84 which is tightly wrapped around the joint 83. However, band 84 is made of plastic which weakens or decomposes when it encounters cold water. When that happens, components 81 and 82 separate, releasing container 85 into the rinse water.

Set forth below is a detailed description of fabric conditioners and optional additives or components, all of which are collectively embraced by the terms conditioner(s) in the specification and claims hereof.

FABRIC CONDITIONING COMPOSITION

For purposes of the present invention a "fabric conditioning agent" is any substance which improves or modifies he chemical or physical characteristics of the fabric being treated therewith. Examples of suitable fabric conditioning agents include perfumes, elasticity improving agents, flame proofing agents, pleating agents, antistatic agents, softening agents, soil proofing agents, water repellent agents, crease proofing agents, acid repellent agents, antishrinking agents, heat proofing agents, coloring material, brighteners, bleaching agents, fluorescers and ironing aids. These agents can be used alone or in combination.

The most preferred fabric conditioning composition for use in the present invention contains antistatic and softener agents. Such agents provide benefits sought by many consumers and the convenience offered by the present invention would serve them well.

The fabric softener/antistat composition employed herein can contain any of the wide variety of nonionic and cationic materials known to supply these benefits. These materials are substantive, and have a melting point within the range of from about 20° C. to about 115° C., preferably within the range of from about 30° C. to about 60° C.

The most common type of cationic softener/antistat materials are the cationic nitrogen-containing compounds such as quaternary ammonium compounds and amines having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

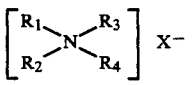

wherein $R_1$ is hydrogen or an aliphatic group of from 1 to 22 carbon atoms; $R_2$ is an aliphatic group having from 12 to 22 carbon atoms; $R_3$ and $R_4$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds of the invention are the dialkyl dimethyl ammonium chlorides, wherein the alkyl groups have from 12 to 22 carbon atoms and are derived from long-chain fatty acids, such as hydrogenated tallow. As employed herein, alkyl is intended as including unsaturated compounds such as are present in alkyl groups derived from naturally occurring fatty oils. The term "tallow" refers to fatty alkyl groups derived from tallow fatty acids. Such fatty acids give rise to quaternary softener compounds wherein $R_1$ and $R_2$ have predominantly from 16 to 18 carbon atoms. The term "coconut" refers to fatty acid groups from coconut oil fatty acids. The coconut-alkyl $R_1$ and $R_2$ groups have from about 8 to about 18 carbon atoms and predominate in $C_{12}$ to $C_{14}$ alkyl groups. Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; disocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats of the invention correspond to the formula

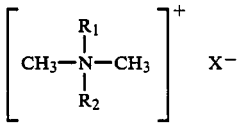

wherein $R_1$ and $R_2$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconutalkyl) dimethyl ammonium methyl sulfate (or chloride), these compounds being preferred from the standpoint of excellent softening properties and ready availability.

Suitable cation-active amine softener/antistat compounds are the primary, secondary and tertiary amine compounds having at least one straight-chain organic group of from 12 to 22 carbon atoms and 1,3-propylene diamine compounds having a straight-chain organic group of from 12 to 22 carbon atoms. Examples of such softener actives include primary tallow amine; primary hydrogenated-tallow amine; tallow 1,3-propylene diamine; oleyl 1,3-propylene diamine; coconut 1,3-propylene diamine; soya 1,3-propylene diamine and the like.

Other suitable cation-active softener/antistat compounds herein are the quaternary imidazolinium salts. Preferred salts are those conforming to the formula

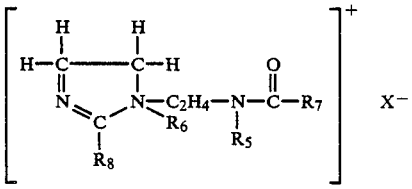

Wherein $R_6$ is an alkyl containing from 1 to 4, preferably from 1 to 2 carbon atoms, $R_5$ is an alkyl containing from 1 to 4 carbon atoms or a hydrogen radical, $R_8$ is an alkyl containing from 1 to 22, preferably at least 15 carbon atoms or a hydrogen radical, $R_7$ is an alkyl containing from 8 to 22, preferably at least 15 carbon atoms, and X is an anion, preferably methylsulfate or chloride ions. Other suitable anions include those disclosed with reference to the cationic quaternary ammonium fabric softener/antistats described hereinbefore. Particularly preferred are those imidazolinium compounds in which both $R_7$ and $R_8$ are alkyls of from 12 to 22 carbon atoms, e.g., 1-methyl-1[(stearoylamide)ethyl]-2-heptadecyl-4,5-dihydroimidazolinium methyl sulfate; 1-methyl-1[(palmitoylamide)ethyl]-2-octadecyl-4,5-dihydroimidazolinium chloride and 1-methyl-1-[(tallowamide) ethyl]-2-tallow-imidazolinium methyl sulfate.

Other cationic quaternary ammonium fabric softener/antistats which are useful herein include, for example, alkyl ($C_{12}$ to $C_{22}$)-pryidinium chlorides, alkyl ($C_{12}$ to $C_{22}$)-alkyl ($C_1$ to $C_3$)-morpholinium chlorides and quaternary derivatives of amino acids and amino esters.

Nonionic fabric softener/antistat materials include a wide variety of materials including sorbitan esters, fatty alcohols and their derivatives, diamine compounds and the like. One preferred type of nonionic fabric antistat/-softener material comprises the esterified cyclic dehydration products of sorbitol, i.e., sorbitan ester. Sorbitol, itself prepared by catalytic hydrogenation of glucose, can be dehydrated in well-known fashion to form mixtures of cyclic, 1,4- and 1,5-sorbitol anhydrides and small amounts of isosorbides. (See Brown; U.S. Pat. No. 2,322,821; issued June 29, 1943) The resulting complex mixtures of cyclic anhydrides of sorbitol are collectively referred to herein as "sorbitan". It will be recognized that this "sorbitan" mixture will also contain some free uncyclized sorbitol.

Sorbitan ester fabric softener/antistat materials useful herein are prepared by esterifying the "sorbitan" mixture with a fatty acyl group in standard fashion, e.g., by reaction with a fatty ($C_{10}$–$C_{24}$) acid or fatty acid halide. The esterification reaction can occur at any of the available hydroxyl groups, and various mono-, di-, etc., esters can be prepared. In fact, complex mixtures of mon-, di , tri-, and tetra-esters almost always result from such reactions, and the stoichiometric ratios of the reactants can simply be adjusted to favor the desired reaction product.

The foregoing complex mixtures of esterified cyclic dehydration products are sorbitol (and small amounts of esterified sorbitol) are collectively referred to herein as "sorbitan esters". Sorbitan mono- and di-esters of lauric, myristic, palmitic, stearic and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails", are useful fabric softener/antistat materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters. The tri- and tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and difatty glycerides which contain at least one "free" OH group.

All manner of water-insoluble, high melting alcohols (including mono- and di-glycerides), are useful herein, inasmuch as all such materials are fabric sustantive. Of course, it is desirable to use those materials which are colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as the fabric softener/antistat material in the instant invention encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_8$, alkyl groups in the molecule are useful fabric conditioning agents.

Non-limiting examples of ester-alcohols useful herein include: glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free —OH group, also fall within the definition of alcohols useful as fabric softener/antistat materials herein. The ether-alcohols can be prepared by the classic Williamson ether synthesis. As with the ester-alcohols, the reaction conditions are chosen such that at least one free, unetherified —OH group remains in the molecule.

Ether-alcohols useful herein include glycerol-1,2-dilauryl ether; glycerol-1,3-distearyl ether; and butane tetra-ol-1,2,3-trioctanyl ether.

Yet another type of nonionic fabric conditioning agent useful herein encompasses the substantially water-insoluble (or dispersible) diamine compounds and diamine derivatives. The diamine fabric conditioning agents are selected from the group consisting of particular alkylated or acylated diamine compounds.

Useful diamine compounds have the general formula $$R_1-\overset{\overset{\displaystyle R_2}{|}}{N}-(CH_2)_n-\overset{\overset{\displaystyle R_3}{|}}{N}-R_4$$

wherein $R_1$ is an alkyl or acyl group containing from about 12 to 20 carbon atoms; $R_2$ and $R_3$ are hydrogen or alkyl of from about 1 to 20 carbon atoms and $R_4$ is hydrogen, $C_{1-20}$ alkyl or $C_{12-20}$ acyl. At least two of $R_2$ , $R_3$ and $R_4$ are hydrogen or alkyl containing 1 to 3 carbon atoms, and n is from 2 to 6.

Non-limiting examples of such alkylated diamine compounds include:

$C_{15}H_{33}$—$N(CH_3)$—$(CH_2)_3$—$N(CH_3)_2$
$C_{18}H_{37}$—$N(CH_3)$—$(CH_2)_2$—$N(C_2H_5)_2$
$C_{12}H_{25}$—$N(CH_3)$—$(CH_2)_3$—HN—$C_{12}H_{25}$
$C_{12}H_{25}$—$N(C_2H_5)$—$(CH_2)_3$—$N(C_3H_7)_2$
$R_{Tallow}NH$—$(CH_2)_3$—$N(C_2H_5)_2$ $C_{20}H_{41}$—$N(CH_3)$—$(CH_2)_2$-$N(CH_3)_2$
$C_{15}H_{31}$—$N(C_2H_5)$—$(CH_2)_3$—$NH_2$
$C_{18}H_{37}$—NH—$(CH_2)_3$—HN—$CH_3$
$C_{16}H_{33}$—NH—$(CH_2)_3$—HN—$C_{16}H_{33}$
$R_{Tallow}N(CH_3)$—$(CH_2)_3$—$N(C_2H_5)_2$
$C_{16}H_{33}N(CH_3)$—$(CH_2)_5$—$N(C_2H_5)_2$
$C_{12}H_{25}N(C_2H_5)$—$(CH_2)_2$—$N(C_3H_7)_2$ and
$C_{14}H_{29}N(CH_3)$—$(CH_2)_3$—$(CH_3)N$—$C_8H_{17}$
wherein in the above formulas $R_{Tallow}$ is the alkyl group derived from tallow fatty acid.

Other examples of suitable akylated diamine compounds include N-tetradecyl, N'-propyl-1,3-propanediamine, N-eicosyl,N,N',N°-triethyl-1,2-ethane-diamine and N-octadecyl,N,N',N'-tripropyl-1,3-propane-diamine.

Examples of suitable acylated diamine fabric softener/antistat materials include $C_{13-20}$ amido amine derivatives.

The fabric softener/antistats mentioned above can be used singly or in combination in the practice of the present invention.

Preferred mixtures useful herein are mixtures of dialkyl dimethyl ammonium salts with imidazolinium salts and mixtures of these two materials with sorbitan esters. An especially preferred mixture includes ditallow dimethyl ammonium methyl sulfate and 1-methyl-1-[(tallowamide)ethyl]-2-tallow imidazolinium methyl sulfate in a ratio of from about 65:35 to about 35:65 and sorbitan tristearate in a ratio of from about 50:50 to about 5:95, sorbitan tristearate to the sum of the other two agents. Tallow alcohol or hydrogenated castor oil may be used to replace sorbitan tristearate in the above mixture with similar results being obtained. Another especially preferred mixture includes the above mixture wherein the sorbitan tristearate is absent and the other two components are present in a ratio from about 65:35 to 35:65.

Another class of desirable fabric conditioning agents used in the articles herein are bleaches. These include the common inorganic peroxy compounds such as alkali metal and ammonium perborates, percarbonates, monopersulfates and monoperphosphates. Solid organic peroxy acids, or the water-soluble, e.g., alkali metal, salts thereof of the general formula

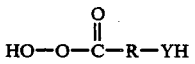

wherein R is a sibsutituted or unsubstituted alkylene or arylene group and Y is

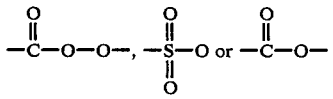

or any other group which yields an anionic group in aqueous solution are also useful herein. These bleaches are more fully described in U.S. Pat. No. 3,749,673, July 31, 1973, Jones et al., incorporated herein by reference.

OPTIONAL COMPONENTS

In a preferred article herein the fabric conditioning composition is a softener/antistat composition in the form of a free flowing powder. To facilitate forming such a powder any of a wide variety of filler materials may be used in the present composition. Such fillers include inorganics such as sodium sulfate, calcium carbonate, aluminum oxide and smectite clays and organics such as high molecular weight polyethylene glycols. Smectite clays and aluminum oxide are preferred fillers herein since they may additionally help in insolubilizing the inner receptacle. A description of smectite clays may be found in U.S. Pat. No. 3,862,058, Jan. 21, 1975, to Nirschl et al., incorporated herein by reference. The filler material may be present at a level ranging from about 5% to 35% by weight of the softener/antistat composition.

The fabric softening/antistat compositions herein can also optionally contain minor proportions (i.e., 0.1% to about 15% by weight of various other ingredients which provide additional fabric conditioning benefits. Such optional ingredients include perfumes, fumigants, bactericides, fungicides, optical brighteners and the like. Specific examples of typical solid, water-soluble additives useful herein can be found in any current Year Book of the American Association of Textile Chemists and Colorists. Such additional components can be selected from those compounds which are known to be compatible with the softener/antistat agents employed herein, or can be coated with water-soluble coatings such as solid soaps, and the like, and thereby rendered compatible.

A preferred optional ingredient is a fabric substantive perfume material. Included among such perfume materials are musk ambrette, musk ketone, musk xylol, ethyl vanillin, musk tibertine, coumarin, aurantiol and mixtures thereof. The above perfumes are preferably used in an amount of from about 0.1% to about 5% by weight of the fabric softener/antistat composition.

The water-soluble silicate materials recognized in the art as corrosion inhibitors can be employed in the present compositions at levels of about 5% by weight.

Release aids such as nonionic surfactants can also be advantageously employed in the present invention.

It will be recognized that any of the foregoing types of optional components can be provided in a solid, particulate form which can be dispensed onto the fabrics concurrently with the fabric softener/antistat to provide the desired additional fabric treatment benefits.

I claim:

1. A container for clothes conditioner(s) and the like, said container comprising at least two components of substantially rigid materials which are held together by frictional engagement at room temperature and wherein the components comprise different materials having substantially different coefficients of linear expansion, whereby one of said components contracts so much more than the other component in the cold rinse water of a washing machine that the components detach and release conditioner(s) into the rinse water of the washing machine.

2. The invention of claim 1 wherein at least one of said components is made of plastic.

3. The invention of claim 1 wherein at least one of said components is made of metal.

4. A container for clothes conditioner(s) and the like, having at least two substantially rigid components which are held together by frictional engagement at room temperature, one of said components having a greater coefficient of linear expansion than the other of said components, whereby one component contracts so much more than the other in cold rinse water that the components detach from each other when the container is in cold rinse water of a washing machine, whereby the conditioner(s) are released into the rinse water.

5. The invention of claim 4 where the container comprises at least two hemispherical components.

* * * * *